US010222716B2

(12) United States Patent
Nishitera

(10) Patent No.: US 10,222,716 B2
(45) Date of Patent: Mar. 5, 2019

(54) ELECTROSTATIC LATENT IMAGE DEVELOPING TONER

(71) Applicant: KYOCERA Document Solutions Inc., Osaka (JP)

(72) Inventor: Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/762,739

(22) PCT Filed: Jul. 13, 2017

(86) PCT No.: PCT/JP2017/025518
§ 371 (c)(1),
(2) Date: Mar. 23, 2018

(87) PCT Pub. No.: WO2018/042903
PCT Pub. Date: Mar. 8, 2018

(65) Prior Publication Data

US 2018/0217516 A1 Aug. 2, 2018

(30) Foreign Application Priority Data

Aug. 29, 2016 (JP) ..... 2016-166900

(51) Int. Cl.
*G03G 9/087* (2006.01)
*G03G 9/097* (2006.01)
*G03G 9/08* (2006.01)

(52) U.S. Cl.
CPC ..... *G03G 9/08755* (2013.01); *G03G 9/08* (2013.01); *G03G 9/087* (2013.01); *G03G 9/0819* (2013.01); *G03G 9/0821* (2013.01); *G03G 9/08711* (2013.01); *G03G 9/08795* (2013.01); *G03G 9/08797* (2013.01); *G03G 9/09725* (2013.01); *G03G 9/09733* (2013.01); *G03G 9/09791* (2013.01)

(58) Field of Classification Search
CPC ..... G03G 9/08755; G03G 9/09725; G03G 9/09733; G03G 9/09791; G03G 9/08797; G03G 9/08711
USPC ..... 430/109.4
See application file for complete search history.

(56) References Cited

U.S. PATENT DOCUMENTS 6,190,814 B1 * 2/2001 Law ..... G03G 9/09716 430/108.7
8,323,749 B2 * 12/2012 Questel ..... C04B 41/009 427/508
8,609,316 B2 12/2013 Hara et al.
8,648,024 B2 * 2/2014 Palla-Venkata ..... A61Q 19/10 424/70.12
2006/0286315 A1 * 12/2006 Hashimoto ..... B41J 2/0057 428/32.34
2011/0171574 A1 7/2011 Hara et al.
2017/0123332 A1 * 5/2017 Uchino ..... G03G 9/0827

FOREIGN PATENT DOCUMENTS

JP 2011-141489 A 7/2011

* cited by examiner

*Primary Examiner* — Janis L Dote
(74) *Attorney, Agent, or Firm* — Studebaker & Brackett PC

(57) ABSTRACT

An electrostatic latent image developing toner includes a plurality of toner particles (10) each including a toner mother particle (11) and an external additive adhering to a surface of the toner mother particle (11). The toner mother particles (11) contain a crystalline polyester resin and a non-crystalline polyester resin. The toner particles (10) include, as the external additive, crystal nucleating agent particles (13) containing a crystal nucleating agent for promoting crystallization of the crystalline polyester resin. On a differential scanning calorimetry spectrum of the toner before fixing, an endotherm quantity of a heat absorption peak originating from a crystalline region of the crystalline polyester resin is less than 2.0 mJ/mg. On a differential scanning calorimetry spectrum of the toner after fixing, an endotherm quantity of a heat absorption peak originating from a crystalline region of the crystalline polyester resin is at least 6.0 mJ/mg.

9 Claims, 1 Drawing Sheet

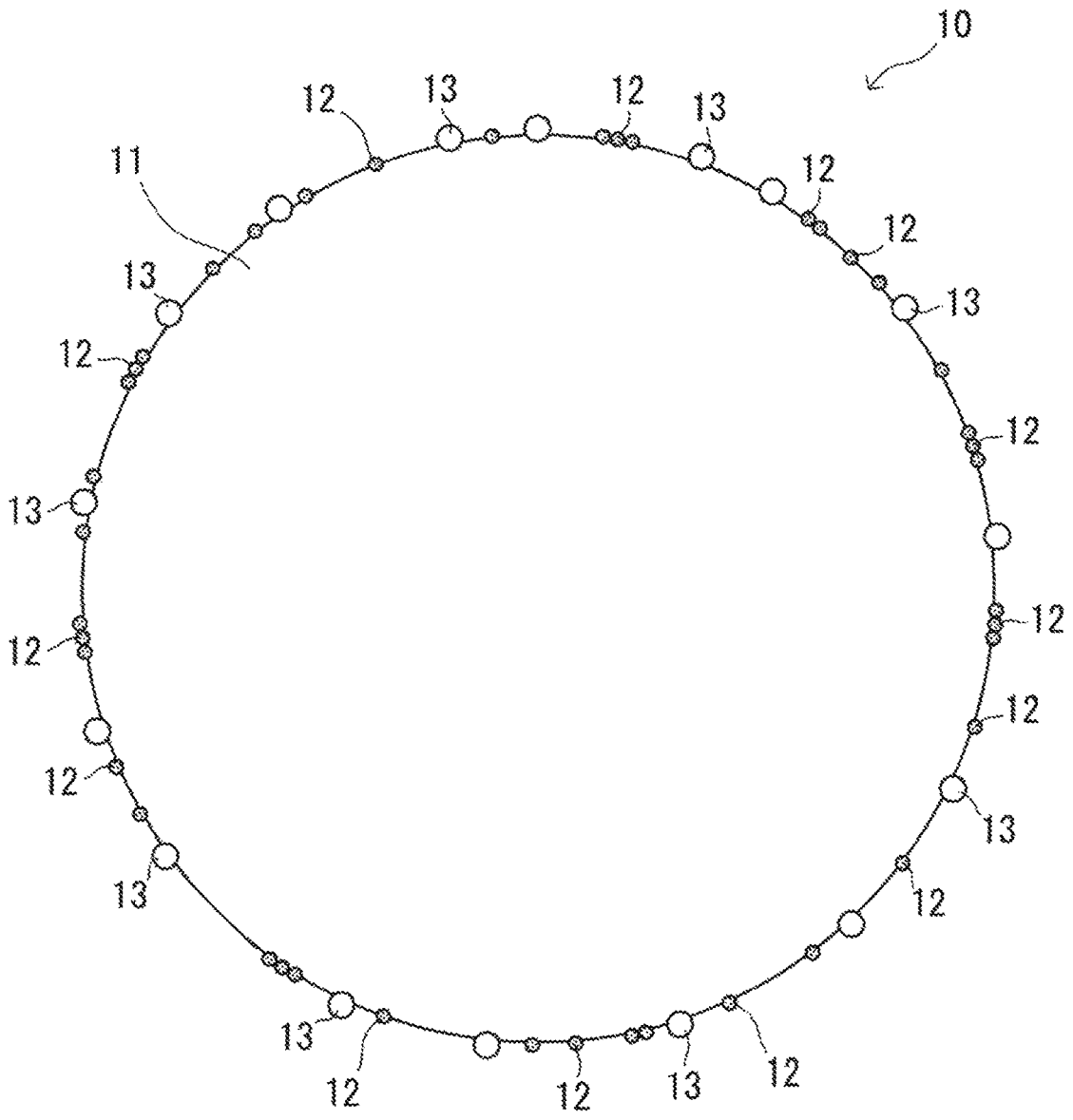
10
11
12
13

ELECTROSTATIC LATENT IMAGE DEVELOPING TONER

TECHNICAL FIELD

The present invention relates to an electrostatic latent image developing toner.

BACKGROUND ART

A method for manufacturing a capsule toner described in Patent Literature 1 includes a mixed resin fine particle attaching step, a spraying step, and a filming step. In the mixed resin fine particle attaching step, particles having mixed resin fine particles adhering thereto are obtained by causing mixed resin fine particles including crystalline polyester resin fine particles and non-crystalline resin fine particles to adhere to surfaces of toner mother particles. In the spraying step, a mixed solution is sprayed to the particles having the mixed resin fine particles adhering thereto in a flowable state. The mixed solution includes a crystal nucleating agent and a liquid for plasticizing the particles having the mixed resin fine particles adhering thereto. In the filming step, a resin coat layer is formed on the surface of each toner mother particle by processing the mixed resin fine particles into a film using impact force.

CITATION LIST

Patent Literature

[Patent Literature 1]
Japanese Patent Application Laid-Open Publication No. 2011-141489

SUMMARY OF INVENTION

Technical Problem

According to Patent Literature 1, crystallization of the crystalline polyester resin fine particles is promoted by the crystal nucleating agent in the resin coat layers (shell layers) of a toner before fixing, and thus preservability of the toner is prevented from being reduced by the crystalline polyester resin. According to Patent Literature 1, low-temperature fixability of the toner is improved by the crystalline polyester resin in the toner mother particles. However, according to Patent Literature 1, the crystalline polyester resin in the toner mother particles of the toner before fixing is crystallized. It is therefore thought that compatibility between the non-crystalline polyester resin and the crystalline polyester resin contained in the toner mother particles is low, reducing low-temperature fixability of the toner. It is not necessarily the case that the technique described in Patent Literature 1 can ensure sufficient low-temperature fixability of the toner. Furthermore, the manufacture of the toner cannot be accomplished without going through complicated manufacturing steps, requiring film formation using impact force after spraying of the mixed solution containing the crystal nucleating agent and the liquid.

The present invention was achieved in consideration of the above problem and an objective thereof is to inhibit document offset while ensuring sufficient low-temperature toner fixability.

Solution to Problem

An electrostatic latent image developing toner according to the present invention includes a plurality of toner particles each including a toner mother particle and an external additive adhering to a surface of the toner mother particle. The toner mother particles contain a crystalline polyester resin and a non-crystalline polyester resin. The toner particles include, as the external additive, crystal nucleating agent particles containing a crystal nucleating agent for promoting crystallization of the crystalline polyester resin. On a differential scanning calorimetry spectrum of the toner before fixing, an endotherm quantity of a heat absorption peak originating from a crystalline region of the crystalline polyester resin is less than 2.0 mJ/mg. On a differential scanning calorimetry spectrum of the toner after fixing, an endotherm quantity of a heat absorption peak originating from a crystalline region of the crystalline polyester resin is at least 6.0 mJ/mg.

Advantageous Effects of Invention

According to the present invention, it is possible to inhibit document offset while ensuring sufficient low-temperature toner fixability.

BRIEF DESCRIPTION OF DRAWINGS

FIGURE illustrates an example of a structure of a toner particle included in an electrostatic latent image developing toner according to an embodiment of the present invention.

DESCRIPTION OF EMBODIMENTS

The following describes an embodiment of the present invention. Unless otherwise stated, evaluation results (values indicating shape and physical properties) for a powder (specific examples include toner mother particles, external additive, and toner) are number averages of values measured for a suitable number of particles included in the powder.

A number average particle diameter of a powder is a number average value of equivalent circle diameters of primary particles of the powder (Heywood diameter: diameters of circles having the same areas as projected areas of the particles) measured using a microscope, unless otherwise stated. A value for a volume median diameter ($D_{50}$) of a powder is measured using a laser diffraction/scattering particle size distribution analyzer ("LA-750", product of Horiba, Ltd.), unless otherwise stated. A value for a mass average molecular weight (Mw) is measured by gel permeation chromatography, unless otherwise stated.

A value for a glass transition point (Tg) is measured in accordance with "Japanese Industrial Standard (JIS) K7121-2012" using a differential scanning calorimeter ("DSC-6220", product of Seiko Instruments Inc.), unless otherwise stated. On a heat absorption curve (vertical axis: heat flow (DSC signal), horizontal axis: temperature) measured using the differential scanning calorimeter during the second heating, the glass transition point (Tg) corresponds to a temperature (onset temperature) at a point of inflection resulting from glass transition (i.e., an intersection point of an extrapolation line of a base line and an extrapolation line of an inclined portion of the curve). A value for a softening point (Tm) is measured using a capillary rheometer ("CFT-500D", product of Shimadzu Corporation), unless otherwise stated. On an S-shaped curve (vertical axis: temperature, horizontal axis: stroke) measured using the capillary rheometer, the softening point (Tm) is a temperature corresponding to a stroke value of "(base line stroke value+maximum stroke value)/2". A value for a melting point (Mp) is a temperature of a peak indicating maximum heat absorption on a heat absorption curve (vertical axis: heat flow (DSC signal), horizontal axis: temperature) measured using a differential scanning calorimeter ("DSC-6220", product of Seiko Instruments Inc.), unless otherwise stated.

Hereinafter, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" may be used as a generic term for both acryl and methacryl.

In the present specification, the term "silica particles" is used to encompass both untreated silica particles (referred to below as a silica base) and silica particles obtained by treating a surface of the silica base (which in other words is surface-treated silica particles). Silica particles rendered positively chargeable using a surface treatment agent may be referred to as "positively chargeable silica particles".

A toner according to the present embodiment is for example suitable for use as a positively chargeable toner for developing an electrostatic latent image. The toner according to the present embodiment is a powder including a plurality of toner particles (particles each having the feature described below). The toner may be used as a one-component developer. Alternatively, a two-component developer may be prepared by mixing the toner and a carrier using a mixer (for example, a ball mill). In order to achieve high quality image formation, a ferrite carrier (specifically, a powder of ferrite particles) is preferably used as the carrier. In order to achieve high quality image formation over an extended period of time, magnetic carrier particles including carrier cores and resin layers coating the carrier cores are preferably used. In order that carrier particles are magnetic, carrier cores thereof may be formed from a magnetic material (for example, ferromagnetic material such as ferrite) or formed from a resin in which magnetic particles are dispersed. Alternatively, magnetic particles may be dispersed in resin layers coating carrier cores. Preferably, the amount of the toner in the two-component developer is at least 5 parts by mass and no greater than 15 parts by mass relative to 100 parts by mass of the carrier in order to achieve high quality image formation. Note that a positively chargeable toner included in a two-component developer is positively charged by friction against a carrier therein.

The toner according to the present embodiment can for example be used in image formation in an electrophotographic apparatus (image forming apparatus). The following describes an example of image forming methods that are performed by electrophotographic apparatuses.

First, an image forming section (a charger and a light exposure device) of an electrophotographic apparatus forms an electrostatic latent image on a photosensitive member (for example, on a surface of a photosensitive drum) based on image data. Next, a developing device (specifically, a developing device having a toner-containing developer loaded therein) of the electrophotographic apparatus supplies the toner to the photosensitive member to develop the electrostatic latent image formed on the photosensitive member. The toner is charged by friction against the carrier, a development sleeve, or a blade in the developing device before being supplied to the photosensitive member. For example, a positively chargeable toner is positively charged. In the developing step, the toner (specifically, the toner charged by friction) on the development sleeve (for example, a surface of a development roller in the developing device) disposed in the vicinity of the photosensitive member is supplied to the photosensitive member and caused to adhere to an irradiated portion of the electrostatic latent image on the photosensitive member, so that a toner image is formed on the photosensitive member. Toner in an amount corresponding to the amount of the toner consumed in the development step is supplied to the developing device from a toner container containing toner for replenishment use.

Subsequently, in a transfer step, a transfer device of the electrophotographic apparatus transfers the toner image on the photosensitive member onto an intermediate transfer member (for example, a transfer belt), and then further transfers the toner image on the intermediate transfer member onto a recording medium (for example, paper). Thereafter, a fixing device (fixing method: nip fixing with a heating roller and a pressure roller) of the electrophotographic apparatus fixes the toner to the recording medium by applying heat and pressure to the toner. As a result, an image is formed on the recording medium. A full-color image can for example be formed by superimposing toner images of four different colors: black, yellow, magenta, and cyan. A direct transfer process may alternatively be employed, which involves direct transfer of the toner image on the photosensitive member to the recording medium without the use of the intermediate transfer member.

The toner particles included in the toner may be toner particles having no shell layers (referred to below as non-capsule toner particles) or may be toner particles having shell layers (referred to below as capsule toner particles). In each of the capsule toner particles, a toner mother particle includes a core and a shell layer covering a surface of the core. The shell layer is substantially composed of a resin. Both heat-resistant preservability and low-temperature fixability of the toner can be achieved for example by using low-melting cores and covering each core with a highly heat-resistant shell layer. An additive may be dispersed in the resin forming the shell layer. The shell layer may entirely cover the surface of each core or partially cover the surface of each core. The shell layer may be substantially composed of a thermosetting resin, may be substantially composed of a thermoplastic resin, or may contain both a thermoplastic resin and a thermosetting resin. The shell layer may be formed by any method. For example, the shell layer may be formed according to an in-situ polymerization process, an in-liquid curing film coating process, or a coacervation process.

The toner according to the present embodiment is an electrostatic latent image developing toner having the following feature (referred to below as the basic feature).

(Basic Feature of Toner)

The electrostatic latent image developing toner includes a plurality of toner particles each including a toner mother particle and an external additive adhering to a surface of the toner mother particle. The toner mother particles contain a crystalline polyester resin and a non-crystalline polyester resin. The toner particles include, as the external additive, particles containing a crystal nucleating agent for promoting crystallization of the crystalline polyester resin (referred to below as crystal nucleating agent particles). On a differential scanning calorimetry spectrum of the toner before fixing, the endotherm quantity of a heat absorption peak originating from a crystalline region of the crystalline polyester resin is less than 2.0 mJ/mg. On a differential scanning calorimetry spectrum of the toner after fixing, the endotherm quantity of a heat absorption peak originating from a crystalline region of the crystalline polyester resin is at least 6.0 mJ/mg. The toner before fixing is the toner that has not been fixed yet (for example, unused toner). The toner after fixing is the toner fixed to a recording medium at an appropriate temperature, which in other words is the toner fixed to a recording medium without experiencing cold offset or hot offset. An endotherm quantity of a heat absorption peak originating from a crystalline region of the crystalline polyester resin on a differential scanning calorimetry spectrum may be referred to below as a "DSC endotherm quantity". A larger DSC endotherm quantity tends to provide a larger quantity of crystalline region in the crystalline polyester resin contained in the toner. The DSC endotherm quantity corresponds to an endotherm quantity in association with melting of the crystalline region of the crystalline polyester resin, and can be determined from the area of the heat absorption peak.

The cold offset is a phenomenon described as an image (specifically, a toner image) including a defect as a result of insufficient fixing of the toner, which is caused when fixing temperature (specifically, heating temperature for fixing the toner) is so low that the toner forming a lower layer of the image fails to receive sufficient heat and melting of the toner is insufficient. The hot offset is a phenomenon described as a portion of the melted toner adhering to a fixing device (for example, a heating roller) as a result of insufficient solidification of the toner, which is caused when fixing temperature is so high that the toner forming an upper layer of an image (specifically, a toner image) excessively melts.

In order to reduce energy consumption in image formation, it is desirable to use a toner having excellent low-temperature fixability. A toner having excellent low-temperature fixability tends not to result in cold offset even when fixed at a low temperature. Thus, the image forming apparatus can adopt a low fixing temperature by using the toner having excellent low-temperature fixability.

In order to increase printing speed (consequently throughput) of the image forming apparatus, it is desirable to use a toner that tends not to result in document offset. The document offset is a phenomenon described as stacked sheets of a recording medium adhering to each other, which is caused when the toner is fixed onto one sheet of the recording medium through heat application and the other sheet of the recording medium is placed on the one sheet still hot.

One possible way to improve low-temperature fixability of the toner is to increase compatibility between the non-crystalline polyester resin and the crystalline polyester resin contained in the toner mother particles. However, the toner improved in low-temperature fixability by such a way tends to easily cause the document offset, because compatibility between the non-crystalline polyester resin and the crystalline polyester resin is high even after the toner is fixed to a recording medium. The present inventor has made a study for achieving an objective to sufficiently inhibit both cold offset and document offset, and as a result arrived at the toner having the above-described feature.

The toner having the above-described feature has a DSC endotherm quantity of less than 2.0 mJ/mg before fixing and a DSC endotherm quantity of at least 6.0 mJ/mg after fixing. The DSC endotherm quantity (specifically, an endotherm quantity of a heat absorption peak originating from a crystalline region of the crystalline polyester resin on a differential scanning calorimetry spectrum) satisfying the above-described relationship means that compatibility between the non-crystalline polyester resin and the crystalline polyester resin contained in the toner mother particles is high before the toner is fixed to a recording medium, and compatibility between the non-crystalline polyester resin and the crystalline polyester resin contained in the toner mother particles is low after the toner is fixed to a recording medium. The present inventor succeeded in maintaining high compatibility between the non-crystalline polyester resin and the crystalline polyester resin in the toner mother particles before the toner is fixed and achieving low compatibility between the non-crystalline polyester resin and the crystalline polyester resin contained in the toner mother particles after the toner is fixed to a recording medium (in a fixed toner image) by adding the crystal nucleating agent particles to the toner particles as an external additive. It is thought that the crystal nucleating agent particles included in the toner particles as an external additive promotes crystallization of the crystalline polyester resin in the toner mother particles after the toner is fixed. It is thought that the crystal nucleating agent particles promote crystallization of the crystalline polyester resin in the toner mother particles through heterogeneous nucleation, causing formation of fine crystals. Crystallization of the crystalline polyester resin in the toner mother particles reduces compatibility between the non-crystalline polyester resin and the crystalline polyester resin contained in the toner mother particle, inhibiting document offset. In the case of a toner that is encompassed by the toner having the above-described basic feature and that is highly producible, the toner has a DSC endotherm quantity of at least 0.5 mJ/mg and less than 2.0 mJ/mg before fixing and has a DSC endotherm quantity of at least 6.0 mJ/mg and less than 10.0 mJ/mg after fixing. A glass transition point of the toner mother particles tends to increase with decrease in compatibility between the non-crystalline polyester resin and the crystalline polyester resin contained in the toner mother particles.

In both an experiment conducted by the present inventor in which a crystal nucleating agent was contained in the toner mother particles as an internal additive and an experiment conducted by the present inventor in which the crystal nucleating agent was contained in the shell layers (specifically, resin coat layers), it was impossible to inhibit document offset while ensuring sufficient low-temperature fixability of the toner. Specifically, crystallization of the crystalline polyester resin proceeded before the toner was fixed to reduce low-temperature fixability of the toner, or crystallization of the crystalline polyester resin was not promoted after the toner had been fixed, failing to sufficiently inhibit document offset.

The following describes an example of a structure of a toner particle included in the toner having the above-described basic feature with reference to FIGURE. FIGURE illustrates an example of a cross-sectional structure of a toner particle included in the toner having the above-described basic feature.

A toner particle 10 illustrated in FIG. 1 includes a toner mother particle 11, a plurality of inorganic particles 12 (for example, silica particles), and a plurality of crystal nucleating agent particles 13. The plurality of inorganic particles 12 and the plurality of crystal nucleating agent particles 13 adhere to a surface of the toner mother particle 11. The toner particle 10 having external additives (inorganic particles 12 and crystal nucleating agent particles 13) is obtained by causing the external additives to adhere to the toner mother particle 11.

The toner mother particle 11 and the external additives (inorganic particles 12 and crystal nucleating agent particles 13) are not chemically reacted with each other. The external additive particles (inorganic particles 12 and crystal nucleating agent particles 13) can for example be caused to adhere to the surface of each toner mother particle 11 by stirring a powder of the toner mother particles 11 and the external additives (specifically, powders of external additive particles) together. In the case of external additive particles having a large particle diameter (crystal nucleating agent particles 13, for example), portions (bottom portions) of the respective external additive particles (crystal nucleating agent particles 13, for example) can be embedded in a surface portion of each toner mother particle 11 to fix the external additive particles to the surface of the toner mother particle 11 by vigorously stirring the toner mother particles 11 and the external additive together. In the case of external additive particles having a small particle diameter or acicular external additive particles (inorganic particles 12, for example), the external additive particles can adhere to the surface of each toner mother particle 11 by surface adhesion properties of both the toner mother particles 11 and the external additive particles or by electrostatic attractive force between the toner mother particles 11 and the external additive particles, without the external additive particles being embedded in the toner mother particles 11. In order to prevent the external additive particles from detaching from the toner particles 10, the external additive particles are preferably strongly attached to the surface of each toner mother particle 11. In order to improve fluidity of the toner by the external additive particles, the external additive particles are preferably weakly attached to the surface of each toner mother particle 11. Preferably, for example, spherical external additive particles are rotatably attached to the surface of each toner mother particle 11. It is thought that the toner has improved fluidity as a result of the external additive particles being able to move while rotating on the surface of each toner mother particle 11.

The toner mother particles 11 contain a crystalline polyester resin and a non-crystalline polyester resin. The crystal nucleating agent particles 13 are for example spherical particles containing a crystal nucleating agent for the crystalline polyester resin (specifically, a crystal nucleating agent for promoting crystallization of the crystalline polyester resin in the toner mother particles 11 after the toner is fixed). The inorganic particles 12 are for example spherical silica particles. The crystal nucleating agent particles 13 for example have a larger number average primary particle diameter than the inorganic particles 12.

In order to obtain a toner suitable for image formation, the toner mother particles preferably have a volume median diameter ($D_{50}$) of at least 4 μm and no greater than 9 μm.

The following describes a preferable example of a composition of non-capsule toner particles. The toner mother particles and the external additives are described in the stated order. Non-essential components may be omitted in accordance with the intended use of the toner. The following toner mother particles of the non-capsule toner particles can be used as cores for capsule toner particles.

[Toner Mother Particles]

(Binder Resin)

The binder resin is typically a main component (for example, at least 80% by mass) of the toner mother particles. Accordingly, properties of the binder resin are thought to have a great influence on overall properties of the toner mother particles. Properties (specific examples include hydroxyl value, acid value, Tg, and Tm) of the binder resin can be adjusted by using different resins in combination for the binder resin. The toner mother particles have a higher tendency to be anionic in a situation in which the binder resin has an ester group, an ether group, an acid group, or a methyl group, and have a higher tendency to be cationic in a situation in which the binder resin has an amino group or an amide group.

In the toner having the above-described basic feature, the toner mother particles contain, as the binder resin, a crystalline polyester resin and a non-crystalline polyester resin.

A polyester resin can be synthesized through polycondensation of at least one polyhydric alcohol (specific examples include aliphatic diols, bisphenols, and tri- or higher-hydric alcohols shown below) with at least one polycarboxylic acid (specific examples include di-, tri-, and higher-basic carboxylic acids shown below). The polyester resin may include a repeating unit derived from another monomer (a monomer that is not a polyhydric alcohol or a polycarboxylic acid; specific examples include styrene-based monomers and acrylic acid-based monomers shown below).

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Examples of preferable styrene-based monomers include styrene, alkylstyrenes (specific examples include α-methylstyrene, p-ethylstyrene, and 4-tert-butylstyrene), p-hydroxy styrene, m-hydroxy styrene, α-chlorostyrene, o-chlorostyrene, m-chlorostyrene, and p-chlorostyrene.

Examples of preferable acrylic acid-based monomers include (meth)acrylic acid, (meth)acrylonitrile, alkyl (meth) acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

A first preferable example of the non-crystalline polyester resin is a polymer of monomers (resin raw materials) including at least one bisphenol (specific examples include bisphenol A ethylene oxide adduct and bisphenol A propylene oxide adduct) and at least one aromatic dicarboxylic acid (for example, terephthalic acid). A second preferable example of the non-crystalline polyester resin is a polymer of monomers (resin raw materials) including at least one bisphenol (for example, two bisphenols: bisphenol A ethylene oxide adduct and bisphenol A propylene oxide adduct), at least one aromatic dicarboxylic acid (for example, terephthalic acid), and at least one α,ω-alkanedicarboxylic acid (for example, adipic acid). A third preferable example of the non-crystalline polyester resin is a polymer of monomers (resin raw materials) including at least one bisphenol (specific examples include bisphenol A ethylene oxide adduct and bisphenol A propylene oxide adduct), at least one aromatic dicarboxylic acid (for example, terephthalic acid), and at least one tri- or higher-basic carboxylic acid (for example, trimellitic acid). Specifically, it is thought that the resin is cross-linked by the tri- or higher-basic carboxylic acid. In the case of the second preferable example of the non-crystalline polyester resin, the non-crystalline polyester resin tends to have a low softening point (for example, a non-crystalline polyester resin having a softening point of less than 100° C.). In the case of the third preferable example of the non-crystalline polyester resin, the non-crystalline polyester resin tends to have a high softening point (for example, a non-crystalline polyester resin having a softening point of at least 120° C.).

In order to achieve both heat-resistant preservability and low-temperature fixability of the toner, the toner mother particles preferably contain a non-crystalline polyester resin having a softening point of less than 100° C. and a non-crystalline polyester resin having a softening point of at least 120° C. The softening point (Tm) of a resin can for example be adjusted by changing the molecular weight of the resin. The molecular weight of a resin can be adjusted by changing conditions for polymerization of the resin (specific examples include amount of a polymerization initiator to use, polymerization temperature, and polymerization time).

Preferably, the crystalline polyester resin is a copolymer of monomers (resin raw materials) including at least one polyhydric alcohol, at least one polycarboxylic acid, at least one styrene-based monomer, and at least one acrylic acid-based monomer. As a result of the crystalline polyester resin contained in the toner mother particles including a repeating unit derived from a styrene-based monomer and a repeating unit derived from an acrylic acid-based monomer, the crystalline polyester resin and the non-crystalline polyester resin contained in the toner mother particles tend to be highly compatible with each other before the toner is fixed.

A preferable example of the crystalline polyester resin is a copolymer of monomers (resin raw materials) including at least one α,ω-alkanediol having a carbon number of at least 2 and no greater than 8 (for example, ethylene glycol having a carbon number of 2), at least one α,ω-alkanedicarboxylic acid having a carbon number of at least 6 and no greater than 14 (for example, sebacic acid), at least one styrene-based monomer (for example, styrene), and at least one acrylic acid-based monomer (for example, butyl methacrylate). The carbon number of the α,ω-alkanedicarboxylic acid includes the carbons of the carboxyl groups thereof. For example, the carbon number of sebacic acid is 10.

Preferably, the crystalline polyester resin contained in the toner mother particles has a crystallinity index of at least 0.90 and no greater than 1.15. The crystallinity index of a resin is equivalent to a ratio (=Tm/Mp) of the softening point (Tm) of the resin to the melting point (Mp) of the resin. Typically, a non-crystalline resin has Tm and Mp that differ greatly. Mp of a non-crystalline polyester resin is often indeterminable.

(Colorant)

The toner mother particles may contain a colorant. A known pigment or dye matching a color of the toner can be used as a colorant. In order to obtain a toner suitable for image formation, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant.

The toner mother particles may include a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may contain a releasing agent. The releasing agent is for example used in order to improve fixability or offset resistance of the toner. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as major component such as montanic acid ester wax and castor wax; and waxes in which a part or all of a fatty acid ester has been deoxidized such as deoxidized carnauba wax. One releasing agent may be used independently, or two or more releasing agents may be used in combination.

In order to improve compatibility between the binder resin and the releasing agent, a compatibilizer may be added to the toner mother particles.

(Charge Control Agent)

The toner mother particles may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent (specific examples include organic metal complexes and chelate compounds). The cationic strength of the toner mother particles can be increased through the toner mother particles containing a positively chargeable charge control agent (specific examples include pyridine, nigrosine, and quaternary ammonium salts). However, when it is ensured that the toner has sufficient chargeability, the toner mother particles do not need to contain a charge control agent.

(Magnetic Powder)

The toner mother particles may contain a magnetic powder. Examples of materials of the magnetic powder that can be preferably used include ferromagnetic metals (specific examples include iron, cobalt, nickel, and alloys of any one or two of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

[External Additive]

The toner particles in the toner having the above-described basic feature include crystal nucleating agent particles (specifically, particles containing a crystal nucleating agent for promoting crystallization of the crystalline polyester resin in the toner mother particles) as an external additive.

Preferably, the crystal nucleating agent for promoting crystallization of the crystalline polyester resin (specifically, the crystal nucleating agent forming the crystal nucleating agent particles) is a salt, an amide, or an ester of a fatty acid having a carbon number of at least 15 and no greater than 30. Such a crystal nucleating agent particularly tends to promote crystallization of a crystalline polyester resin that is a copolymer of monomers (resin raw materials) including at least one polyhydric alcohol, at least one polycarboxylic acid, at least one styrene-based monomer, and at least one acrylic acid-based monomer. The carbon number of the fatty acid includes the carbons of the carboxyl group thereof. For example, the carbon number of stearic acid is 18. The following describes preferable examples of crystal nucleating agents for the crystalline polyester resin with reference to formulae (1) to (4).

A crystal nucleating agent represented by formula (1) is an ester of stearic acid (a fatty acid having a carbon number of 18). Specifically, the crystal nucleating agent represented by formula (1) is stearyl stearate (an ester of stearic acid and stearyl alcohol). The stearyl stearate includes two carbon skeletons (one on the left side of the ester bond "—C(=O)—O—" in formula (1) and one on the right side thereof) each having a carbon number of at least 15 and no greater than 30.

[Formula 1]

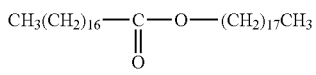

(1)

A crystal nucleating agent represented by formula (2) is a salt of stearic acid (a fatty acid having a carbon number of 18). Specifically, the crystal nucleating agent represented by formula (2) is calcium stearate. The calcium stearate includes two carbon skeletons ("$CH_3(CH_2)_{16}$—" at the left end of formula (2) and "—$(CH_2)_{16}CH_3$" at the right end thereof) each having a carbon number of at least 15 and no greater than 30. A crystal nucleating agent including two or more carbon skeletons each having a carbon number of at least 15 and no greater than 30 (specifically, a crystal nucleating agent for the crystalline polyester resin) is obtained by forming a salt of a monobasic carboxylic acid having a carbon number of at least 16 and no greater than 31 (including the carbons of the carboxyl group) and di- or higher valent metal ion.

[Formula 2]

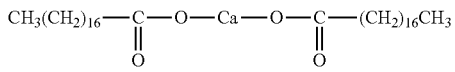

(2)

Crystal nucleating agents represented by formulae (3) and (4) are each an amide of stearic acid (a fatty acid having a carbon number of 18). Specifically, the crystal nucleating agent represented by formula (3) is stearamide. The crystal nucleating agent represented by formula (4) is N,N'-ethylene bis-octadecanamide. The stearamide includes only one carbon skeleton having a carbon number of at least 15 and no greater than 30. The N,N'-ethylene bis-octadecanamide includes two carbon skeletons ("$CH_3(CH_2)_{16}$—" at the left end of formula (4) and "—$(CH_2)_{16}CH_3$" at the right end thereof) each having a carbon number of at least 15 and no greater than 30.

[Formula 3]

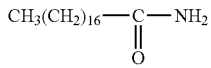

(3)

[Formula 4]

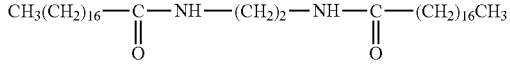

(4)

In order that crystallization of the crystalline polyester resin proceeds favorably, the crystal nucleating agent particles preferably have a number average primary particle diameter of at least 30 nm and no greater than 100 nm, and the amount of the crystal nucleating agent particles is preferably at least 1.0 part by mass and no greater than 5.0 parts by mass relative to 100 parts by mass of the toner particles.

In order to improve fluidity or handleability of the toner, the toner particles preferably further include silica particles as an external additive. In order to increase positive chargeability of the toner, the toner particles preferably include positively chargeable silica particles as an external additive. In order to allow the silica particles and the crystal nucleating agent particles to sufficiently exhibit their functions, it is preferable that the crystal nucleating agent particles have a number average primary particle diameter of at least 30 nm and no greater than 100 nm, the amount of the crystal nucleating agent particles is at least 1.0 part by mass and no greater than 5.0 parts by mass relative to 100 parts by mass of the toner particles, the silica particles have a number average primary particle diameter of at least 5 nm and no greater than 25 nm, and the amount of the silica particles is at least 0.5 parts by mass and no greater than 2.0 parts by mass relative to 100 parts by mass of the toner particles.

Optional external additive particles (particles that are not the crystal nucleating agent particles or the silica particles) may be caused to adhere to the surface of each toner mother particle. Examples of preferable optional external additive particles include particles of a metal oxide (specific examples include alumina, titanium oxide, magnesium oxide, zinc oxide, strontium titanate, and barium titanate). Alternatively or additionally, particles of an organic acid compound such as a fatty acid metal salt (specific examples include zinc stearate) or resin particles may be used as the external additive particles. Alternatively or additionally, composite particles, which are particles of a composite of a plurality of materials, may be used as the external additive particles.

The external additive particles may be surface-treated. For example, in a situation in which silica particles are used as the external additive particles, either or both of hydrophobicity and positive chargeability may be imparted to surfaces of the silica particles using a surface treatment agent. Examples of surface treatment agents that can be preferably used include coupling agents (specific examples include silane coupling agents, titanate coupling agents, and aluminate coupling agents) and silicone oils (specific examples include dimethylsilicone oil). As a silane coupling agent, a silane compound (specific examples include methyltrimethoxysilane and aminosilane) may be used or a silazane compound (specific examples include hexamethyldisilazane (HMDS)) may be used. When a surface of a silica base (untreated silica particle) is treated with the surface treatment agent, a large number of hydroxyl groups (—OH) on the surface of the silica base are partially or entirely replaced by functional groups derived from the surface treatment agent. As a result, silica particles having the functional groups derived from the surface treatment agent (specifically, functional groups that are more hydrophobic and/or more readily positively chargeable than the hydroxyl groups) on surfaces thereof are obtained.

[Toner Production Method]

In order to produce the toner having the above-described basic feature easily and favorably, for example, the production preferably includes a melt-kneading process, a pulverization process, a classification process, and an external additive addition process described below.

(Melt-Kneading Process)

The following describes an example of the melt-kneading process. In the melt-kneading process, toner materials including at least a crystalline polyester resin and a non-crystalline polyester resin (for example, crystalline polyester resin, a plurality of non-crystalline polyester resins, a colorant, and a releasing agent) are mixed to give a mixture. A mixer (for example, an FM mixer) can be suitably used for mixing the toner materials. Additionally or alternatively, a masterbatch including a binder resin and a colorant may be used for the toner materials.

Subsequently, the resultant mixture is melt-kneaded to give a melt-kneaded product. A twin-screw extruder, a three-roll kneader, or a two-roll kneader can be suitably used for melt-kneading the mixture.

(Pulverization and Classification Processes)

The following describes examples of the pulverization process and the classification process. First, the melt-kneaded product is cooled to solidify using a cooling and solidifying device such as a drum flaker. Subsequently, the resultant solidified product is coarsely pulverized using a first pulverizer. Thereafter, the resultant coarsely pulverized product is further pulverized using a second pulverizer. Subsequently, the resultant pulverized product is classified using a classifier (for example, an air classifier). Through the above, toner mother particles having a desired particle diameter are obtained.

(External Additive Addition Process)

In the external additive addition process, external additives including at least crystal nucleating agent particles (for example, crystal nucleating agent particles and silica particles) are caused to adhere to the surfaces of the toner mother particles. The external additives can be caused to adhere to the surfaces of the toner mother particles by mixing the toner mother particles and the external additives using a mixer under conditions that prevent the external additives from being embedded in the toner mother particles. Only the crystal nucleating agent particles, out of the crystal nucleating agent particles and the silica particles, may be embedded in the toner mother particles.

Through the above-described processes, a toner including a large number of toner particles can be produced. Note that non-essential processes may be omitted. In a situation in which a commercially available product can be used as is as a material, for example, a process of preparing the material can be omitted by using the commercially available product. In order to obtain a specific compound, a salt, an ester, a hydrate, or an anhydride of the compound may be used as a material thereof. Preferably, a large number of the toner particles are formed at the same time in order to produce the toner efficiently. Toner particles that are produced at the same time are thought to have substantially the same structure as one another.

EXAMPLES

The following describes Examples of the present invention. Table 1 shows toners (electrostatic latent image developing toners) TA-1 to TA-7 and TB-1 to TB-4 according to Examples and Comparative Examples.

TABLE 1

| | Crystalline polyester resin | | | Crystal nucleating agent particles | |
|---|---|---|---|---|---|
| | | DSC endotherm quantity [mJ/mg] | | | Amount |
| Toner | Type | Before fixing | After fixing | Type | [parts by mass] |
| TA-1 | CPES-A | 0.8 | 6.5 | NA-1 | 1.0 |
| TA-2 | CPES-A | 0.8 | 6.6 | NA-1 | 2.0 |
| TA-3 | CPES-B | 1.4 | 6.9 | NA-1 | 1.0 |
| TA-4 | CPES-C | 1.9 | 7.2 | NA-1 | 1.0 |
| TA-5 | CPES-A | 0.8 | 7.8 | NA-2 | 1.0 |
| TA-6 | CPES-A | 0.8 | 7.3 | NA-3 | 1.0 |
| TA-7 | CPES-A | 0.8 | 6.0 | NA-4 | 1.0 |

TABLE 1-continued

| | Crystalline polyester resin | | | Crystal nucleating agent particles | |
|---|---|---|---|---|---|
| | | DSC endotherm quantity [mJ/mg] | | | Amount |
| Toner | Type | Before fixing | After fixing | Type | [parts by mass] |
| TB-1 | CPES-A | 0.8 | 1.4 | None | — |
| TB-2 | CPES-A | 0.8 | 3.6 | NA-1 | 0.5 |
| TB-3 | CPES-D | 3.6 | 7.8 | NA-1 | 1.0 |
| TB-4 | CPES-E | 6.7 | 9.3 | NA-1 | 1.0 |

The following describes a production method, evaluation methods, and evaluation results of the toners TA-1 to TA-7 and TB-1 to TB-4 in the stated order. In evaluations in which errors might occur, an evaluation value was calculated by obtaining an appropriate number of measured values and calculating the arithmetic mean of the measured values in order to ensure that any errors were sufficiently small.

[Preparation of Materials]

(Synthesis of Non-Crystalline Polyester Resin PES-A)

A four-necked flask having a capacity of 10 L and equipped with a thermometer, a glass nitrogen inlet tube, a stirrer (stainless steel stirring impeller), and a falling-type condenser (heat exchanger) was charged with 100 g of an adduct of bisphenol A with 2 moles of ethylene oxide (EO), 100 g of an adduct of bisphenol A with 2 moles of propylene oxide (PO), 50 g of terephthalic acid, 30 g of adipic acid, and 54 g of tin(II) 2-ethylhexanoate. Subsequently, the flask was placed on a heating mantle, and a nitrogen atmosphere (inert atmosphere) was maintained in the flask with nitrogen gas introduced into the flask through the nitrogen inlet tube. Subsequently, the flask contents were heated up to 235° C. under stirring in the nitrogen atmosphere. The flask contents were then caused to react (polycondensation reaction) at a temperature of 235° C. in the nitrogen atmosphere while the flask contents were stirred until all the resin raw materials (raw material monomers) melted. Subsequently, the internal pressure of the flask was reduced, and the flask contents were caused to react at a temperature of 235° C. in the reduced pressure atmosphere (pressure 8.0 kPa) until Tm of a reaction product (polyester resin) was a specific temperature (90° C.). As a result, a non-crystalline polyester resin PES-A having a glass transition point (Tg) of 30° C. and a softening point (Tm) of 90° C. was obtained.

(Synthesis of Non-Crystalline Polyester Resin PES-B)

A four-necked flask having a capacity of 10 L and equipped with a thermometer, a glass nitrogen inlet tube, a stirrer (stainless steel stirring impeller), and a falling-type condenser (heat exchanger) was charged with 200 g of an adduct of bisphenol A with 2 moles of EO, 90 g of terephthalic acid, and 54 g of tin(II) 2-ethylhexanoate. Subsequently, the flask was placed on a heating mantle, and a nitrogen atmosphere (inert atmosphere) was maintained in the flask with nitrogen gas introduced into the flask through the nitrogen inlet tube. Subsequently, the flask contents were heated up to 235° C. under stirring in the nitrogen atmosphere. The flask contents were then caused to react (polycondensation reaction) at a temperature of 235° C. in the nitrogen atmosphere while the flask contents were stirred until all the resin raw materials (raw material monomers) melted. Subsequently, the internal pressure of the flask was reduced, and the flask contents were caused to further react (specifically, polymerization reaction) for 1.5 hours (90 minutes) at a temperature of 235° C. in the reduced pressure atmosphere (pressure 8.0 kPa).

Subsequently, the internal temperature of the flask was reduced to 210° C., and the flask contents were caused to react through addition of 380 g (2 moles) of trimellitic anhydride into the flask at a temperature of 210° C. in the reduced pressure atmosphere (pressure 8.0 kPa) until Tm of a reaction product (cross-linked polyester resin) was a specific temperature (140° C.). As a result, a non-crystalline polyester resin PES-B having a glass transition point (Tg) of 60° C. and a softening point (Tm) of 140° C. was obtained.

(Synthesis of Crystalline Polyester Resin CPES-A)

A four-necked flask having a capacity of 10 L and equipped with a thermometer, a glass nitrogen inlet tube, a stirrer (stainless steel stirring impeller), and a falling-type condenser (heat exchanger) was charged with 69 g of ethylene glycol, 214 g of sebacic acid, and 54 g of tin(II) 2-ethylhexanoate. Subsequently, the flask was placed on a heating mantle, and a nitrogen atmosphere (inert atmosphere) was maintained in the flask with nitrogen gas introduced into the flask through the nitrogen inlet tube. Subsequently, the flask contents were heated up to 235° C. over 2 hours under stirring in the nitrogen atmosphere. After heating, the flask contents were caused to react (polycondensation reaction) under stirring at a temperature of 235° C. in the nitrogen atmosphere until a reaction completion rate reached at least 95% by mass. The reaction completion rate was calculated in accordance with the following equation: "Reaction completion rate=100×actual amount of water generated by reaction/theoretical amount of water generated by reaction".

Subsequently, the flask contents were cooled to 160° C., and a liquid mixture of 156 g of styrene, 195 g of n-butyl methacrylate, and 0.5 g of di-tert-butyl peroxide was dripped into the flask over 1 hour. After completion of dripping, the flask contents were stirred for 30 minutes while the temperature of the flask contents was maintained at 160° C. (aging process). Subsequently, the internal temperature of the flask was increased, and the internal pressure of the flask was reduced to cause the flask contents to react for 1 hour at a temperature of 200° C. in the reduced pressure atmosphere (pressure 8 kPa). Subsequently, the flask contents were cooled to 180° C. Subsequently, the internal pressure of the flask was returned to standard pressure, a radical polymerization inhibitor (4-tert-butylcatechol) was added into the flask, and the flask contents were heated up to 210° C. over 2 hours to cause the flask contents to react for 1 hour at 210° C. Subsequently, the internal pressure of the flask was reduced, and the flask contents were caused to react for 2 hours at a temperature of 210° C. in the reduced pressure atmosphere (pressure 40 kPa). As a result, a crystalline polyester resin CPES-A having a melting point (Mp) of 68° C. was obtained.

(Synthesis of Crystalline Polyester Resin CPES-B)

A crystalline polyester resin CPES-B was synthesized according to the same method as the synthesis method of the crystalline polyester resin CPES-A in all aspects other than that 100 g of 1,4-butanediol was used instead of 69 g of ethylene glycol. The thus obtained crystalline polyester resin CPES-B had a melting point (Mp) of 74° C.

(Synthesis of Crystalline Polyester Resin CPES-C)

A crystalline polyester resin CPES-C was synthesized according to the same method as the synthesis method of the crystalline polyester resin CPES-A in all aspects other than that 131 g of 1,6-hexanediol was used instead of 69 g of ethylene glycol. The thus obtained crystalline polyester resin CPES-C had a melting point (Mp) of 78° C.

(Synthesis of Crystalline Polyester Resin CPES-D)

A crystalline polyester resin CPES-D was synthesized according to the same method as the synthesis method of the crystalline polyester resin CPES-A in all aspects other than that 224 g of 1,12-dodecanediol was used instead of 69 g of ethylene glycol. The thus obtained crystalline polyester resin CPES-D had a melting point (Mp) of 86° C.

(Synthesis of Crystalline Polyester Resin CPES-E)

A crystalline polyester resin CPES-E was synthesized according to the same method as the synthesis method of the crystalline polyester resin CPES-A in all aspects other than that the liquid mixture of 156 g of styrene, 195 g of n-butyl methacrylate, and 0.5 g of di-tert-butyl peroxide were not used (the above-described dripping and aging process were not performed). The thus obtained crystalline polyester resin CPES-E had a melting point (Mp) of 68° C.

[Toner Production Method]

(Preparation of Toner Mother Particles)

With respect to each of the toners, 35 parts by mass of a first non-crystalline resin (non-crystalline polyester resin PES-A), 35 parts by mass of a second non-crystalline resin (non-crystalline polyester resin PES-B), 12 parts by mass of a crystalline polyester resin as shown in Table 1 (one of the crystalline polyester resins CPES-A to CPES-E that was specified for the toner), 9 parts by mass of a releasing agent (ester wax: "NISSAN ELECTOL (registered Japanese trademark) WEP-8", product of NOF Corporation), and 9 parts by mass of a colorant (carbon black: "MA-100", product of Mitsubishi Chemical Corporation) were mixed using an FM mixer ("FM-20B", product of Nippon Coke & Engineering Co., Ltd.).

For example, in the production of the toner TA-1, 35 parts by mass of the non-crystalline polyester resin PES-A, 35 parts by mass of the non-crystalline polyester resin PES-B, 12 parts by mass of the crystalline polyester resin CPES-A, 9 parts by mass of the releasing agent (NISSAN ELECTOL WEP-8), and 9 parts by mass of the colorant (MA-100) were mixed. For another example, in the production of the toner TA-3, 12 parts by mass of the crystalline polyester resin CPES-B was used instead of 12 parts by mass of the crystalline polyester resin CPES-A used in the production of the toner TA-1.

Subsequently, the resultant mixture was melt-kneaded under conditions of a material feeding speed of 100 g/minute, a shaft rotational speed of 150 rpm, and a cylinder temperature of 100° C. using a twin-screw extruder ("PCM-30", product of Ikegai Corp.). Thereafter, the resultant kneaded product was cooled. Subsequently, the cooled kneaded product was coarsely pulverized using a pulverizer ("ROTOPLEX (registered Japanese trademark)", product of Hosokawa Micron Corporation) under a condition of a set particle diameter of 2 mm. Subsequently, the resultant coarsely pulverized product was finely pulverized using a pulverizer ("Turbo Mill Type RS", product of FREUND-TURBO CORPORATION). Subsequently, the resultant finely pulverized product was classified using a classifier (classifier using the Coanda effect: "Elbow Jet Type EJ-LABO", product of Nittetsu Mining Co., Ltd.). As a result, toner mother particles having a volume median diameter ($D_{50}$) of 6.7 μm were obtained.

(External Additive Addition Process)

Subsequently, external additives were added to the resultant toner mother particles. Specifically, with respect to each of the toners, the toner mother particles, crystal nucleating agent particles of a type (one of crystal nucleating agent particles NA-1 to NA-4 that is specified for the toner) in an amount as shown in Table 1, and 1 part by mass of positively chargeable silica particles ("AEROSIL (registered Japanese trademark) REA90", product of Nippon Aerosil Co., Ltd., content: dry silica particles to which positive chargeability was imparted through surface treatment, number average primary particle diameter: 20 nm) were mixed for 5 minutes using an FM mixer (product of Nippon Coke & Engineering Co., Ltd.) having a capacity of 10 L to cause the external additives (crystal nucleating agent particles and silica particles) to adhere to the surfaces of the toner mother particles. The amount of the toner mother particles was determined such that the total amount of the toner mother particles, the crystal nucleating agent particles, and the positively chargeable silica particles was 100 parts by mass. However, no crystal nucleating agent particles were used in the production of the toner TB-1.

In Table 1, the crystal nucleating agent particles NA-1 were N,N'-ethylene bis-octadecanamide particles ("E0243", product of Tokyo Chemical Industry Co., Ltd.). The crystal nucleating agent particles NA-2 were stearyl stearate particles ("EXCEPARL (registered Japanese trademark) SS", product of Kao Corporation). The crystal nucleating agent particles NA-3 were calcium stearate particles ("S0236", product of Tokyo Chemical Industry Co., Ltd.). The crystal nucleating agent particles NA-4 were stearamide particles ("S0075", product of Tokyo Chemical Industry Co., Ltd.). For example, in the production of the toner TA-1, 98 parts by mass of the toner mother particles, 1 part by mass of the crystal nucleating agent particles NA-1 (N,N'-ethylene bis-octadecanamide particles), and 1 part by mass of the positively chargeable silica particles (AEROSIL REA90) were mixed for 5 minutes using the FM mixer. For another example, in the production of the toner TA-7, 1 part by mass of the crystal nucleating agent particles NA-4 (stearamide particles) were used instead of 1 part by mass of the crystal nucleating agent particles NA-1 used in the production of the toner TA-1. For another example, in the production of the toner TA-2, 97 parts by mass of the toner mother particles, 2 parts by mass of the crystal nucleating agent particles NA-1 (N,N'-ethylene bis-octadecanamide particles), and 1 part by mass of the positively chargeable silica particles (AEROSIL REA90) were mixed for 5 minutes using the FM mixer.

Subsequently, the resultant powder was sifted using a 200 mesh sieve (pore size 75 μm). As a result, each of the toners (toners TA-1 to TA-7 and TB-1 to TB-4 shown in Table 1) including a large number of toner particles was obtained.

With respect to each of the toners TA-1 to TA-7 and TB-1 to TB-4 obtained as described above, the DSC endotherm quantity (specifically, endotherm quantity of a crystalline region of the crystalline polyester resin determined from a differential scanning calorimetry spectrum) of the toner before fixing and after fixing was measured. Table 1 shows the results. For example, the toner TA-1 had a DSC endotherm quantity of 0.8 mJ/mg before fixing and a DSC endotherm quantity of 6.5 mJ/mg after fixing. The DSC endotherm quantity was measured according to a method described below.

(Preparation of Measurement Sample)

As the toner before fixing, a toner produced according to the method described above (measurement target: each of the toners TA-1 to TA-7 and TB-1 to TB-4) was used as it was. As the toner after fixing, a toner fixed to evaluation paper ("$C^2$90", A4 size 90 g/$m^2$ plain paper, product of Fuji Xerox Co., Ltd.) using a printer (evaluation apparatus obtained by modifying "FS-05250DN", product of KYOCERA Document Solutions Inc., to enable adjustment of fixing temperature) having a roller-roller type heat-pressure fixing device was used. Specifically, a two-component developer including a toner produced according to the method described above (measurement target: each of the toners TA-1 to TA-7 and TB-1 to TB-4) was loaded in the printer. A solid image having a size of 25 mm×25 mm was formed on the evaluation paper at a linear velocity of 200 mm/second and a toner application amount of 1.0 mg/cm$^2$ under environmental conditions of a temperature of 23° C. and a relative humidity of 55%, and the solid image was fixed to obtain a toner image fixed to the evaluation paper. The two-component developer was prepared by mixing 100 parts by mass of a developer carrier (carrier for FS-05250DN) and 5 parts by mass of the toner for 30 minutes using a ball mill. The fixing temperature (specifically, a temperature of a heating roller of the fixing device) was 10° C. higher than a minimum fixable temperature (minimum fixable temperature+10° C.) of each toner shown in Table 2. For example, the fixing temperature for the toner TA-1 was 116° C. (=106° C.+10° C.). It is thought that each toner can be fixed adequately so long as the fixing temperature is 10° C. higher than the minimum fixable temperature of the toner. The solid image on the evaluation paper (specifically, toner image fixed to the evaluation paper) was scraped to collect a measurement sample (toner after fixing).

<DSC Endotherm Quantity Measurement Method>

A screw tube bottle having a capacity of 50 mL was charged with 50 mL of hexane and 0.1 mg of a measurement sample (toner before fixing or toner after fixing). Subsequently, the screw tube bottle was set in an ultrasonic cleaner ("US-18KS", product of SND Co., Ltd., high-frequency output: 360 W, oscillation method: self-excited oscillation by bolt-clamped Langevin transducer (BLT), oscillatory frequency: 38 kHz). Subsequently, the toner was dispersed through three-minute sonication using the ultrasonic cleaner. Subsequently, the sonicated toner dispersion was filtered by suction. Thereafter, re-slurring through addition of 50 mL of hexane, three-minute sonication, and filtering by suction were repeated three times to remove the releasing agent adhering to the surfaces of the toner particles.

After the releasing agent adhering to the surfaces of the toner particles was removed as described above, a differential scanning calorimetry spectrum (vertical axis: heat flow (DSC signal), horizontal axis: time) of the toner was measured using a differential scanning calorimeter ("DSC-6220", product of Hitachi High-Tech Science Corporation). Specifically, 10 mg of the toner was loaded in the differential scanning calorimeter, and the differential scanning calorimetry spectrum (heat absorption curve) of the toner was obtained in a measurement temperature range of 25° C. to 200° C. and with a heating rate of 10° C./minute. The endotherm quantity (DSC endotherm quantity) of a heat absorption peak originating from a crystalline region of the crystalline polyester resin in the toner was determined from the area of the heat absorption peak originating from the crystalline region of the crystalline polyester resin on the thus obtained differential scanning calorimetry spectrum of the toner. Note that the differential scanning calorimetry spectrum included a heat absorption peak (specific examples include a heat absorption peak originating from the crystal nucleating agent) other than the heat absorption peak originating from the crystalline region of the crystalline polyester resin (referred to below as a target peak). In the measurement of the DSC endotherm quantity, the target peak was distinguished from among a plurality of heat absorption peaks based on the peak shape or the like, and only the endotherm quantity of the target peak was determined.

[Evaluation Methods]

Each of the samples (toners TA-1 to TA-7 and TB-1 to TB-4) was evaluated according to methods described below.

(Image Formation Conditions)

A two-component developer was prepared by mixing 100 parts by mass of a developer carrier (carrier for FS-05250DN) with 5 parts by mass of the sample (toner) for 30 minutes using a ball mill.

A printer (evaluation apparatus obtained by modifying "FS-05250DN", product of KYOCERA Document Solutions Inc., to enable adjustment of fixing temperature) having a roller-roller type heat-pressure fixing device was used as an evaluation apparatus. The two-component developer prepared as described above was loaded into a developing device of the evaluation apparatus, and the sample (toner for replenishment use) was loaded into a toner container of the evaluation apparatus.

The evaluation apparatus was used to form a solid image (specifically, unfixed toner image) having a size of 25 mm×25 mm on paper ("C$^2$90", A4 size 90 g/m$^2$ plain paper, product of Fuji Xerox Co., Ltd.) in a portion thereof that was 10 mm away from a trailing end of the paper at a linear velocity of 200 mm/second and a toner application amount of 1.0 mg/cm$^2$ under environmental conditions of a temperature of 23° C. and a relative humidity of 55%. Subsequently, the paper with the image (unfixed toner image) formed thereon was passed through the fixing device of the evaluation apparatus.

(Low-Temperature Fixability)

The fixing temperature was set to within a range of 100° C. to 150° C. to evaluate minimum fixable temperature. The fixing temperature of the fixing device was increased in increments of 2° C. from 100° C. to determine the minimum temperature at which the solid image (toner image) was fixable to the paper (minimum fixable temperature). Determination of whether or not the toner was fixable was carried out through a fold-rubbing test described below. Specifically, the evaluation paper passed through the fixing device was folded with a surface on which the image was formed facing inward and a 1 kg weight covered with cloth was rubbed back and forth on the fold with the image five times. Subsequently, the paper was opened up and a fold portion (portion on which the solid image was formed) of the paper was observed. Then, the length of toner peeling of the fold portion (peeling length) was measured. The minimum fixable temperature was determined to be the lowest temperature among fixing temperatures for which the peeling length was no greater than 1 mm. Low-temperature fixability was evaluated as "good" if the minimum fixable temperature was less than 110° C. and evaluated as "poor" if the minimum fixable temperature was equal to or greater than 110° C.

(Document Offset)

Of the solid images formed in the low-temperature fixability evaluation, the solid image (fixed toner image) fixed at the minimum fixable temperature (for example, 106° C. in the case of the toner TA-1) was evaluated in terms of document offset. Specifically, two sheets each having an image (toner image fixed at the minimum fixable temperature) formed thereon were stacked with sides thereof each having the image in contact with each other. The two sheets were stacked such that the image formed on one sheet was in contact with both an imaged portion and a non-imaged portion of the other sheet. The stacked two sheets were then placed on a table and subjected to load. The stacked two sheets under a pressure of 80 g/cm$^2$ were left to stand for 3 days under environmental conditions of a temperature of 32.5° C. and a relative humidity of 80.0%. Thereafter, the stacked two sheets were separated, and a state of the image (specifically, toner image fixed at the minimum fixable temperature) on each sheet and occurrence of image transfer (whether or not the image formed on the one sheet transferred to the non-imaged portion of the other sheet) were observed, and document offset was evaluated in accordance with the following standard.

A: Image transfer did not occur, and no image defect was found in both the sheets.

B: Image transfer occurred, but no image defect was found in both the sheets.

C: An image defect was found in at least one of the sheets, but the image defect was to a small degree: roughening or reduced glossiness was found in the image, but no void defect was found in the image.

D. An image defect was found in at least one of the sheets, and the image defect was to a large degree: a plurality of obvious void defects were found in the image.

E. The stacked two sheets adhered to each other so strongly that at least one of the sheets was damaged when the sheets were separated.

[Evaluation Results]

Table 2 shows results of the low-temperature fixability (minimum fixable temperature) evaluation and the document offset evaluation of the toners TA-1 to TA-7 and TB-1 to TB-4.

TABLE 2

| | Toner | Low-temperature fixability [° C.] | Document offset |
|---|---|---|---|
| Example 1 | TA-1 | 106 | B |
| Example 2 | TA-2 | 106 | A |
| Example 3 | TA-3 | 108 | B |
| Example 4 | TA-4 | 108 | A |
| Example 5 | TA-5 | 106 | A |
| Example 6 | TA-6 | 106 | A |
| Example 7 | TA-7 | 106 | C |
| Comparative Example 1 | TB-1 | 106 | E |
| Comparative Example 2 | TB-2 | 106 | D |
| Comparative Example 3 | TB-3 | 124 (poor) | B |
| Comparative Example 4 | TB-4 | 118 (poor) | B |

The toners TA-1 to TA-7 (toners according to Examples 1 to 7) each had the above-described basic feature. The toner mother particles of each of the toners TA-1 to TA-7 contained a crystalline polyester resin and a non-crystalline polyester resin. The toner particles thereof included crystal nucleating agent particles (specifically, particles containing a crystal nucleating agent for promoting crystallization of the crystalline polyester resin) as an external additive. The endotherm quantity of the heat absorption peak originating from the crystalline region of the crystalline polyester resin on the differential scanning calorimetry spectrum of the toner before fixing was less than 2.0 mJ/mg (see Table 1). The endotherm quantity of the heat absorption peak originating from the crystalline region of the crystalline polyester resin on the differential scanning calorimetry spectrum of the toner after fixing was at least 6.0 mJ/mg (see Table 1). The crystal nucleating agent particles NA-1 to NA-3 (Table 1) had a number average primary particle diameter of at least 60 nm and no greater than 80 nm.

With respect to each of the toners TA-1 to TA-7, as shown in Table 2, it was possible to inhibit document offset while ensuring sufficient low-temperature fixability of the toner.

INDUSTRIAL APPLICABILITY

The electrostatic latent image developing toner according to the present invention is usable for image formation in copiers, printers, or multifunction peripherals, for example.

The invention claimed is:

1. An electrostatic latent image developing toner comprising a plurality of toner particles each including a toner mother particle and an external additive adhering to a surface of the toner mother particle, wherein the toner mother particles contain a crystalline polyester resin and a non-crystalline polyester resin, the toner particles include, as the external additive, crystal nucleating agent particles containing a crystal nucleating agent for promoting crystallization of the crystalline polyester resin, on a differential scanning calorimetry spectrum of the toner before fixing, an endotherm quantity of a heat absorption peak originating from a crystalline region of the crystalline polyester resin is less than 2.0 mJ/mg, on a differential scanning calorimetry spectrum of the toner after fixing, an endotherm quantity of a heat absorption peak originating from a crystalline region of the crystalline polyester resin is at least 6.0 mJ/mg, the crystal nucleating agent particles have a number average primary particle diameter of at least 30 nm and no greater than 100 nm, and an amount of the crystal nucleating agent particles is at least 1.0 part by mass and no greater than 5.0 parts by mass relative to 100 parts by mass of the toner particles.

2. The electrostatic latent image developing toner according to claim 1, wherein the crystalline polyester resin is a copolymer of monomers including at least one polyhydric alcohol, at least one polycarboxylic acid, styrene, and butyl methacrylate.

3. The electrostatic latent image developing toner according to claim 1, wherein the crystalline polyester resin is a copolymer of monomers including at least one α, ω-alkanediol having a carbon number of at least 2 and no greater than 8, at least one α, ω-alkanedicarboxylic acid having a carbon number of at least 6 and no greater than 14, styrene, and butyl methacrylate.

4. The electrostatic latent image developing toner according to claim 2, wherein the crystal nucleating agent includes a compound represented by chemical formula (1), (2), (3), or (4) shown below

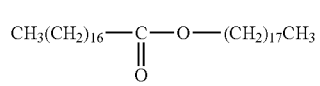

(1)

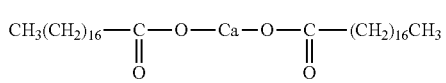

(2)

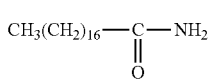

(3)

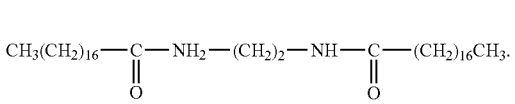

(4)

5. The electrostatic latent image developing toner according to claim 2, wherein the crystal nucleating agent is a salt of a monobasic carboxylic acid having a carbon number of at least 16 and no greater than 31 and a di- or higher valent metal ion, and includes two or more carbon skeletons each having a carbon number of at least 15 and no greater than 30.

6. The electrostatic latent image developing toner according to claim 2, wherein the crystal nucleating agent is a salt, an amide, or an ester of a fatty acid having a carbon number of at least 15 and no greater than 30.

7. The electrostatic latent image developing toner according to claim 2, wherein the crystal nucleating agent is a salt, an amide, or an ester of stearic acid.

8. The electrostatic latent image developing toner according to claim 1, wherein the toner particles further include silica particles as the external additive, the silica particles have a number average primary particle diameter of at least 5 nm and no greater than 25 nm, and an amount of the silica particles is at least 0.5 parts by mass and no greater than 2.0 parts by mass relative to 100 parts by mass of the toner particles.

9. The electrostatic latent image developing toner according to claim 8, wherein the toner mother particles contain, as the non-crystalline polyester resin, a non-crystalline polyester resin having a softening point of less than 100° C. and a non-crystalline polyester resin having a softening point of at least 120° C.

* * * * *